US011108184B2

(12) United States Patent
Ikeya et al.

(10) Patent No.: US 11,108,184 B2
(45) Date of Patent: Aug. 31, 2021

(54) ELECTICAL CONNECTOR HOUSING WITH GUIDE PORTION FOR A RETAINER THAT LOCKS IN TERMINALS

(71) Applicant: YAZAKI CORPORATION, Tokyo (JP)

(72) Inventors: Kazuhide Ikeya, Makinohara (JP); Hikaru Anma, Makinohara (JP); Sho Kasuya, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/865,419

(22) Filed: May 4, 2020

(65) Prior Publication Data

US 2020/0388947 A1 Dec. 10, 2020

(30) Foreign Application Priority Data

Jun. 4, 2019 (JP) ..... JP2019-104717

(51) Int. Cl.
*H01R 13/436* (2006.01)
*H01R 13/502* (2006.01)
(Continued)

(52) U.S. Cl.
CPC ..... *H01R 13/4362* (2013.01); *H01R 13/502* (2013.01); *H01R 13/5219* (2013.01); *H01R 13/424* (2013.01); *H01R 13/629* (2013.01); *H01R 13/6271* (2013.01); *H01R 13/6272* (2013.01)

(58) Field of Classification Search
CPC ..... H01R 13/4362; H01R 13/502; H01R 13/5219; H01R 13/424; H01R 13/629; H01R 13/6271; H01R 13/6272; H01R 13/4361
See application file for complete search history.

(56) References Cited

U.S. PATENT DOCUMENTS

2002/0115345 A1 8/2002 Nakamura et al.
2009/0035981 A1 2/2009 Lim
(Continued)

FOREIGN PATENT DOCUMENTS

CN 101359794 A 2/2009
EP 2 020 704 A2 2/2009
(Continued)

*Primary Examiner* — Abdullah A Riyami
*Assistant Examiner* — Justin M Kratt
(74) *Attorney, Agent, or Firm* — Kenealy Vaidya LLP

(57) ABSTRACT

A housing includes a housing main body which has a fitting portion configured to be fitted with a mating housing and having a terminal accommodating chamber, and a hood portion which covers a periphery of the fitting portion. The housing further includes an annular seal member configured to be attached to a base part of the fitting portion, and a retainer configured to be inserted into a retainer accommodating hole to lock a terminal accommodated in the terminal accommodating chamber. An opening portion through which the retainer passes to be inserted into the retainer accommodating hole is formed at a position facing the retainer accommodating hole in the hood portion. A guide portion that guides the retainer into the retainer accommodating hole is provided at an edge portion of the opening portion.

4 Claims, 7 Drawing Sheets

(51) Int. Cl.

| | |
|---|---|
| ***H01R 13/52*** | (2006.01) |
| *H01R 13/627* | (2006.01) |
| *H01R 13/424* | (2006.01) |
| *H01R 13/629* | (2006.01) |

(56) References Cited

U.S. PATENT DOCUMENTS

| | | | | |
|---|---|---|---|---|
| 2010/0068911 | A1 | 3/2010 | Nagano et al. | |
| 2017/0025780 | A1* | 1/2017 | Kida ..... | H01R 13/5219 |

FOREIGN PATENT DOCUMENTS

| | | | |
|---|---|---|---|
| JP | 2002-252056 | A | 9/2002 |
| JP | 2010-73375 | A | 4/2010 |
| WO | 2015/151887 | A1 | 10/2015 |

* cited by examiner

ELECTICAL CONNECTOR HOUSING WITH GUIDE PORTION FOR A RETAINER THAT LOCKS IN TERMINALS

CROSS REFERENCE TO RELATED APPLICATIONS

This application is based on Japanese Patent Application (No. 2019-104717) filed on Jun. 4, 2019, the contents of which are incorporated herein by reference.

BACKGROUND OF THE INVENTION

1. Field of the Invention

The present invention relates to a housing.

2. Description of the Related Art

As a housing in which a terminal is accommodated in a terminal accommodating chamber, there is a housing provided with a spacer (retainer) inserted and removed from the side of a housing body of the housing (for example, JP-A-2002-252056). In the housing, the terminal accommodated in the terminal accommodating chamber is locked by the spacer. Further, an annular packing (seal member) is attached to the housing to seal a fitting position with a mating housing.

However, when the spacer is inserted with a wrong position, the spacer may interfere with the packing. In particular, when the attached packing is shifted toward an insertion position of the spacer, the packing is bitten and damaged by the inserted spacer, and there is a possibility that good sealing performance by the packing may not be secured.

SUMMARY

The present invention has been made in view of the above circumstances, and an object thereof is to provide a housing in which a retainer that locks a terminal can be smoothly inserted and removed without interfering with an attached seal member.

In order to achieve the above object, the housing according to the present invention is characterized by the following (1) to (3).

There is provided a housing including:

a housing main body having:

a fitting portion configured to be fitted with a mating housing and having a terminal accommodating chamber in which a terminal is accommodated; and a hood portion which covers a periphery of the fitting portion; an annular seal member configured to be attached to a base part of the fitting portion and to seal a fitting position of the fitting portion and the mating housing; and a retainer configured to be inserted into a retainer accommodating hole and to lock the terminal accommodated in the terminal accommodating chamber, the retainer accommodating hole being formed in the fitting portion and being opened at a side part of the fitting portion, in which an opening portion through which the retainer passes to be inserted into the retainer accommodating hole is formed at a position facing the retainer accommodating hole in the hood portion; and in which a guide portion that is slidably in contact with the retainer to guide the retainer into the retainer accommodating hole when the retainer is inserted into the retainer accommodating hole is provided at an edge portion of the opening portion.

(2) For example, in the housing according to the item (1), the opening portion has a window portion through which the seal member attached to the fitting portion is able to be visually checked by an operator.

(3) For example, in the housing according to the item (2), the window portion is provided at each of both sides of the guide portion on the opening portion.

(4) For example, in the housing according to any one of the items (1) to (3), a positioning protruding portion that positions the retainer is provided at an edge portion of the retainer accommodating hole.

According to the housing having the configuration of (1), when the retainer is inserted into the retainer accommodating hole of the fitting portion through the opening portion, the retainer is guided to the retainer accommodating hole by the guide portion provided at the edge portion of the opening portion. Accordingly, damage to the seal member due to the shift of the retainer through the opening portion and interference with the seal member can be prevented, and good sealing performance by the seal member can be secured.

According to the housing having the configuration of (2), in the window portions, it is possible to visually check whether or not the seal member is attached to the base of the fitting portion and the state of the attached seal member.

According to the housing having the configuration of (3), the retainer guided by the guide portion of the opening portion and inserted into the retainer accommodating hole can be accurately positioned by the positioning protruding portion on the edge portion of the retainer accommodating hole. Accordingly, the accuracy of the locking position of a terminal by the retainer can be improved, and the rattling of the terminal accommodated in the terminal accommodating chamber can be prevented.

According to the present invention, it is possible to provide a housing in which a retainer that locks a terminal can be smoothly inserted and removed without interfering with an attached seal member.

The present invention is briefly described as above. Further, details of the present invention will be clarified by reading a mode (hereinafter, referred to as "embodiment") for carrying out the invention to be described below with reference to the accompanying drawings.

BRIEF DESCRIPTION OF THE DRAWINGS

FIGS. 34 and 33 are views illustrating the female housing, in which

FIGS. 5A and 5B are views showing a retainer, in which FIG. 5A is a perspective view as viewed from a front side, and FIG. 5B is a perspective view as viewed from a rear side.

FIGS. 6A and 6B are views illustrating a retainer accommodating hole and an opening portion, in which FIG. 6A is a back view of the female housing before the retainer is mounted, and FIG. 6B is a back view of the female housing after the retainer is mounted.

FIGS. 7A and 7B are views illustrating the retainer accommodating hole and the opening portion, in which FIG. 7A is a cross-sectional view corresponding to FIG. 2 before the retainer is mounted, and FIG. 7B is a cross-sectional view corresponding to FIG. 2 after the retainer is mounted.

DETAILED DESCRIPTION OF THE EXEMPLARY EMBODIMENTS

Hereinafter, an embodiment according to the present invention will be described with reference to the drawings.

Figure 1:
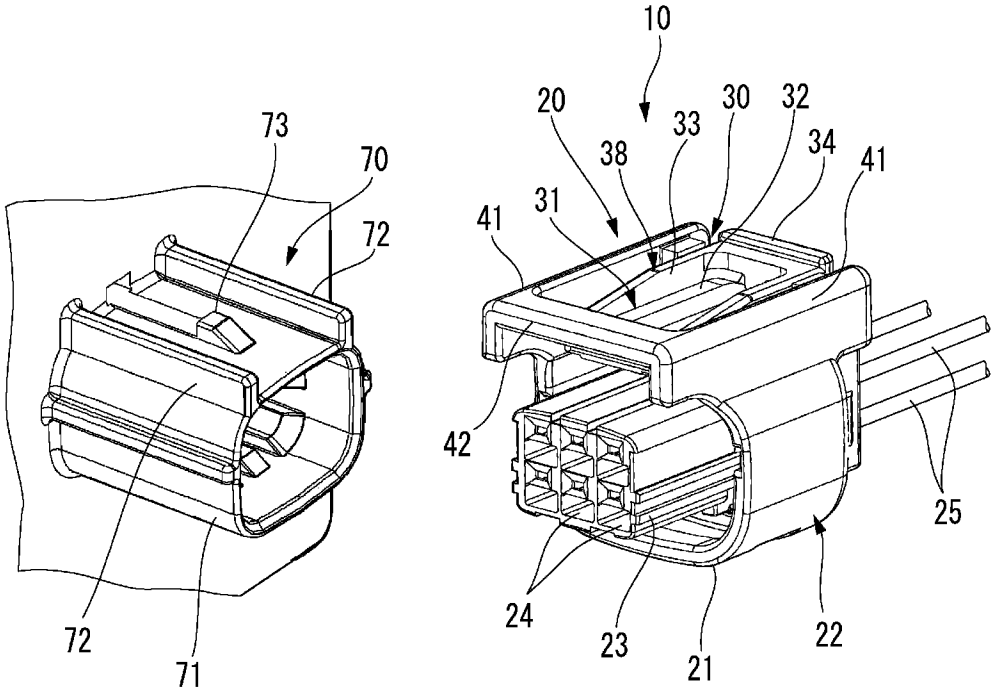
FIG. 1 is a perspective view of a female housing according to the present embodiment and a male housing.

FIG. 1 is a perspective view of a female housing and a mating housing according to the present embodiment.

As shown in FIG. 1, a female housing (housing) 20 according to the present embodiment and a male housing (mating housing) 70 configure a connector 10.

The female housing 20 has a housing main body 22 in which a hood portion 21 is formed. The male housing 70 includes a connection portion 71, and the hood portion 21 of the housing main body 22 of the female housing 20 and the connection portion 71 of the male housing 70 are joined with each other by fitting.

The male housing 70 is formed of a synthetic resin. A plurality of male terminals (not shown) is provided in the male housing 70, and these male terminals are disposed in the connection portion 71.

The male housing 70 has a pair of guiding ridges 72 and a protruding portion 73 which are provided on the connection portion 71. The guiding ridges 72 are formed along a direction fitting with the female housing 20 (hereinafter, simply referred to as fitting direction), and are spaced apart from each other. The protruding portion 73 is formed at a center position in a width direction on the connection portion 71 between the pair of guiding ridges 72. The protruding portion 73 protrudes from an upper surface of the connection portion 71, and is formed with, on a leading side in the fitting direction, a guide surface 74 that is gradually inclined upward toward a rear end side of the male housing 70.

Figure 2:
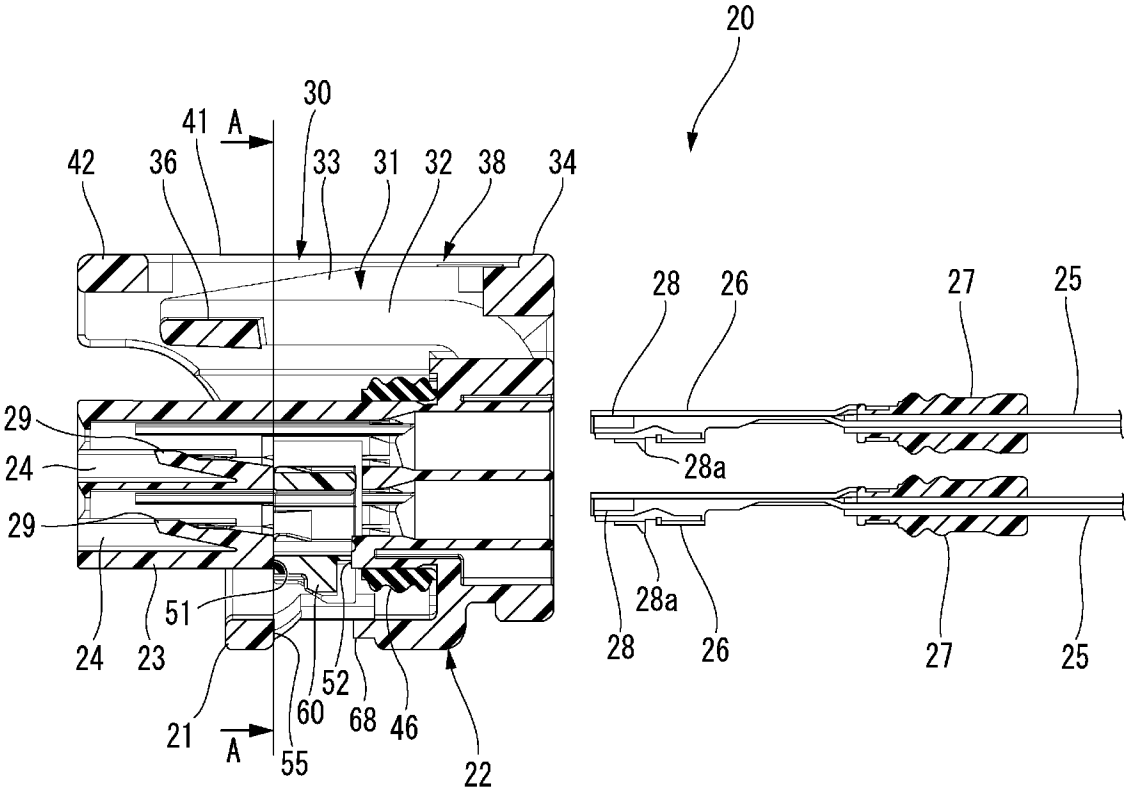
FIG. 2 is a cross-sectional view of the female housing along a longitudinal direction.

FIG. 2 is a cross-sectional view of the female housing along a longitudinal direction.

As shown in FIG. 2, the hood portion 21 formed in the housing main body 22 of the female housing 20 is formed in a tubular shape. The female housing 20 is formed of a synthetic resin, and the housing main body 22 has a fitting portion 23 inside the hood portion 21. The fining portion 23 has a plurality of terminal accommodating chambers 24 which are provided to protrude in a direction of fitting with the male housing 70 (hereinafter, simply referred to as fining direction).

At the base of the fitting portion 23, an annular seal member 46 that seals a fitting position with the male housing 70 from a tip end side is mounted. The seal member 46 is formed of, for example, an elastic material such as rubber, so as to be in close contact with the connection portion 71 of the male housing 70 fitted to the hood portion 21 of the female housing 20. Therefore, the fitting position of the male housing 70 and the female housing 20 is sealed by the seal member 46.

Female terminals 26 connected to end portions of electric wires 25 are respectively accommodated in the terminal accommodating chambers 24 of the fitting portions 23, and the electric wires 25 are drawn out from a rear end of the housing main body 22. A rubber stopper 27 attached to the electric wire 25 is fitted into the terminal accommodating chamber 24 from the rear end side of the housing main body 22. Accordingly, the terminal accommodating chambers 24 of the housing main body 22 in which the female terminals 26 are accommodated are sealed.

The female terminal 26 is formed of, for example, a conductive metal material such as copper or a copper alloy, and is connected to the electric wire 25 by crimping. The female terminal 26 has a rectangular tubular electrical connection portion 28 at a tip end side thereof into which a male terminal is inserted and removed. The electrical connection portion 28 is formed with a protruding piece 28*a* that protrudes laterally.

Lances 29 protruding into respective terminal accommodating chambers 24 are formed in the fitting portion 23, and these lances 29 lock the protruding pieces 28*a* formed on the electrical connection portions 28 of the female terminals 26 which are inserted and accommodated in the terminal accommodating chambers 24. As a result, the female terminals 26 are prevented from falling out of the terminal accommodating chambers 24.

Figure 3A:
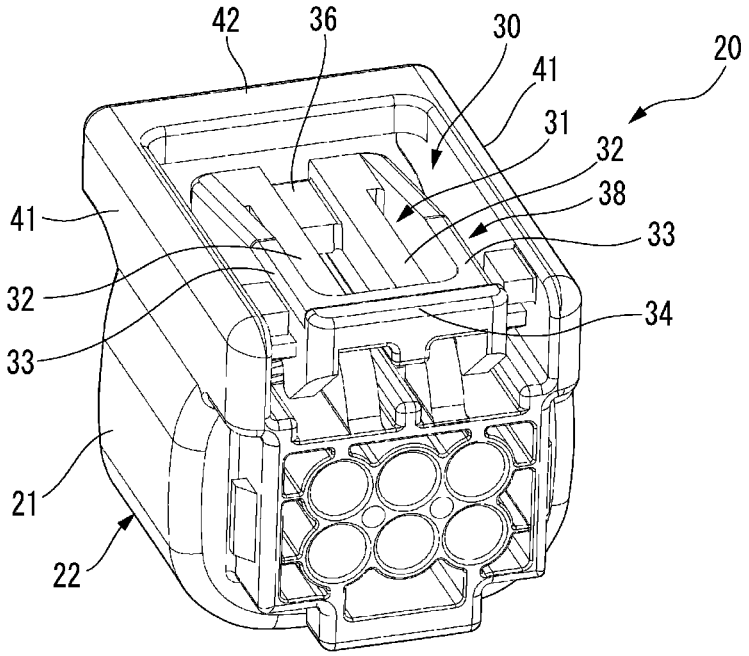
FIG. 3A is a perspective view of an upper portion of the female housing as viewed from a rear side.
Figure 3B:
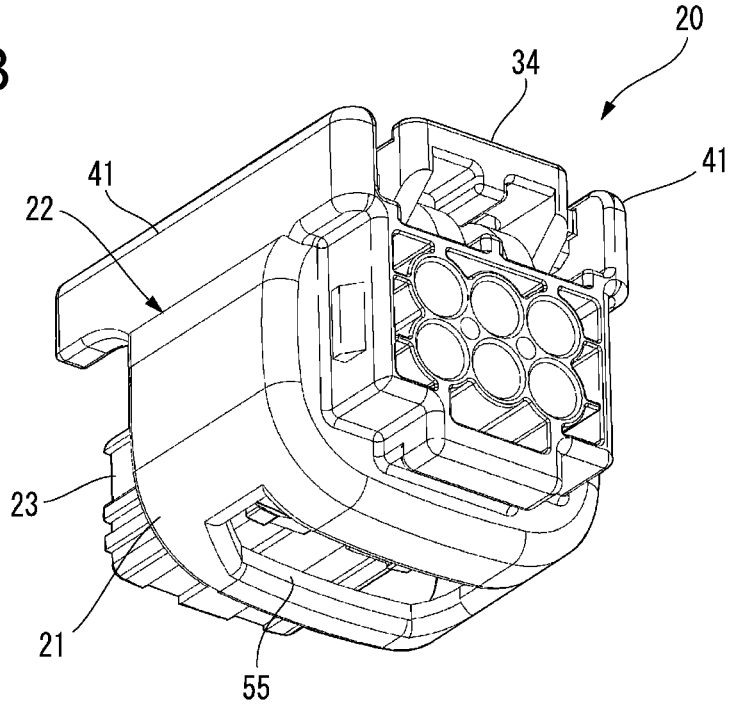
FIG. 3B is a perspective view of a lower portion of the female housing as viewed from the rear side.
Figure 4:
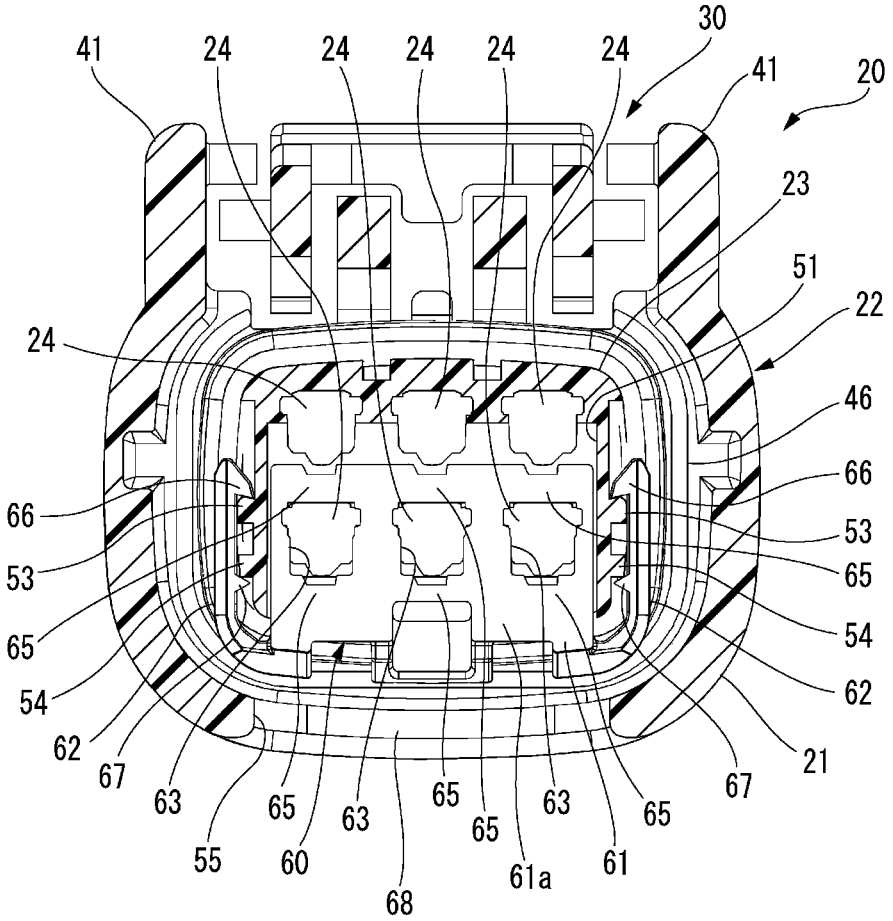
FIG. 4 is a cross-sectional view taken along a line A-A in FIG. 2.

FIGS. 3A and 3B are views illustrating the female housing, in which FIG. 3A is a perspective view of an upper portion of the female housing as viewed from the rear side, and FIG. 3B is a perspective view of a lower portion of the female housing as viewed from the rear side. FIG. 4 is a sectional view taken along a line A-A in FIG. 2.

As shown in FIGS. 3A and 3B, a lock mechanism 30 is provided on an upper portion of the housing main body 22 in the female housing 20. The lock mechanism 30 includes a lock arm 31 and a release arm 38.

The lock arm 31 includes a pair of elastic arm portions 32 and a locking portion 36. The elastic arm portion 32 is formed in a cantilevered support beam shape that is connected to the housing main body 22 and extends toward the leading side in the fitting direction. The elastic arm portions 32 are arranged in parallel and spaced apart from each other. The elastic arm portions 32 are connected with each other at the leading side in the fitting direction. In the lock arm 31, a connecting portion of the elastic arm portions 32 which are connected to each other is the locking portion 36, and the locking portion 36 is disengaged from the protruding portion 73 formed on the male housing 70.

The release arm 38 includes a pair of support arm portions 33 and an operation portion 34. The support arm portions 33 are provided on an outer side of the pair of elastic arm portions 32, respectively. An end portion of the support arm portion 33 on the leading side in the fitting direction is connected to the elastic arm portion 32 and extends toward a rear side in the fitting direction. Rear end portions of the support arm portions 33 are connected on a side opposite to the side on which the elastic arm portion 32 is connected, and the connecting portion is the operation portion 34.

A pair of protective walls 41 is provided on both side portions of the lock mechanism 30. These protective walls 41 are erected on the upper portion of the housing main body 22, and the lock mechanism 30 is protected by being surrounded on the sides by the protective walls 41. A beam portion 42 is provided on the leading side in the fitting direction of the protective walls 41. Both ends of the beam portion 42 are connected to the protective walls 41, and the beam portion 42 is spaced apart from the housing main body 22.

As shown in FIGS. 2 and 4, in the fitting portion 23 of the female housing 20, a retainer accommodating hole 51 opened on a lower side which is the side of the housing main body 22 is formed. The retainer accommodating hole 51 is formed on a rear end side of the lance 29 in the fitting portion 23, and on a tip end side of the base where the seal member 46 is attached. An edge portion on a rear side of the housing main body 22 is protruded from the retainer accommodating hole 51 along the width direction, and the protruded part becomes a positioning protruding portion 52, Further, an opening portion 55 is formed in the hood portion 21 of the female housing 20 on the lower side of the housing main body 22. The opening portion 55 is formed at a position facing the retainer accommodating hole 51.

Further, the fitting portion 23 is formed with a temporary locking protrusion 53 and a final locking protrusion 54 on both side portions thereof. The temporary locking protrusion 53 is disposed on an upper side of the housing main body 22 with respect to the final locking protrusion 54.

A retainer 60 formed of a synthetic resin is inserted into and removed from the retainer accommodating hole 51 so as to be attached and detached. The retainer 60 is inserted into and removed from the retainer accommodating hole 51 of the fitting portion 23 through the opening portion 55 of the hood portion 21.

Figure 5A:
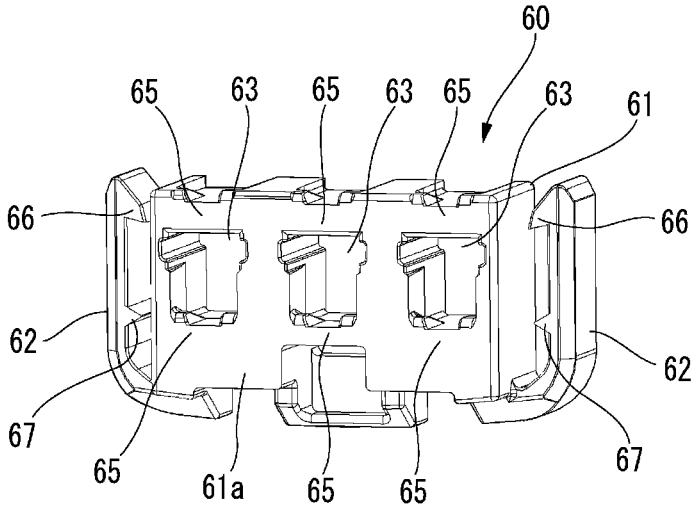
Figure 5B:
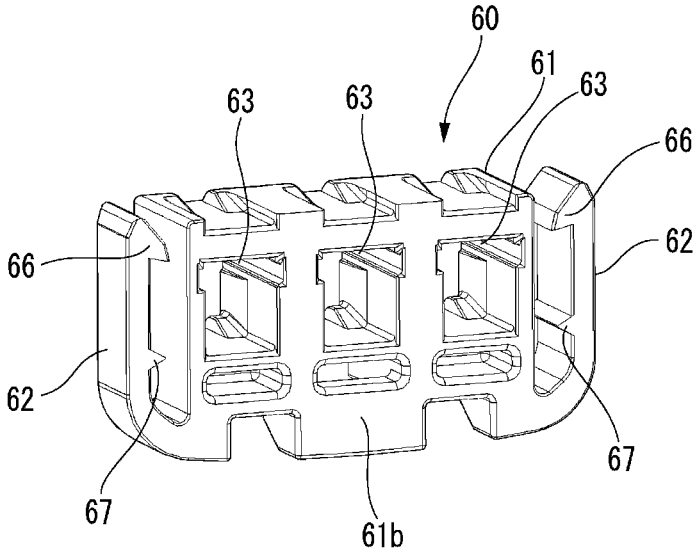

FIGS. 5A and 5B are views showing the retainer, in which FIG. 5A is a perspective view as viewed from a front side, and FIG. 5B is a perspective view as viewed from a rear side.

As shown in FIGS. 5A and 5B, the retainer 60 has a retainer main body 61 formed in a plate shape having a thickness, and locking pieces 62 formed on both side portions of the retainer main body 61. The retainer main body 61 is formed with a plurality of holes 63 penetrating through a front surface 61*a* and a rear surface 61*b*. These holes 63 can communicate with the terminal accommodating chambers 24 at a lower stage of the fitting portion 21 in the retainer main body 61 of the retainer 60, an upper edge portion of the front surface 61*a* and a lower edge portion of each hole 63 serve as a terminal locking portion 65.

The locking pieces 62 formed on both side portions of the retainer main body 61 extend upward from a lower end of the retainer main body 61. A temporary locking claw 66 and a final locking claw 67 protruding inward are formed on the locking piece 62. The temporary locking claw 66 is formed on a tip end side of the locking piece 62 with respect to the final locking claw 67.

Figure 6A:
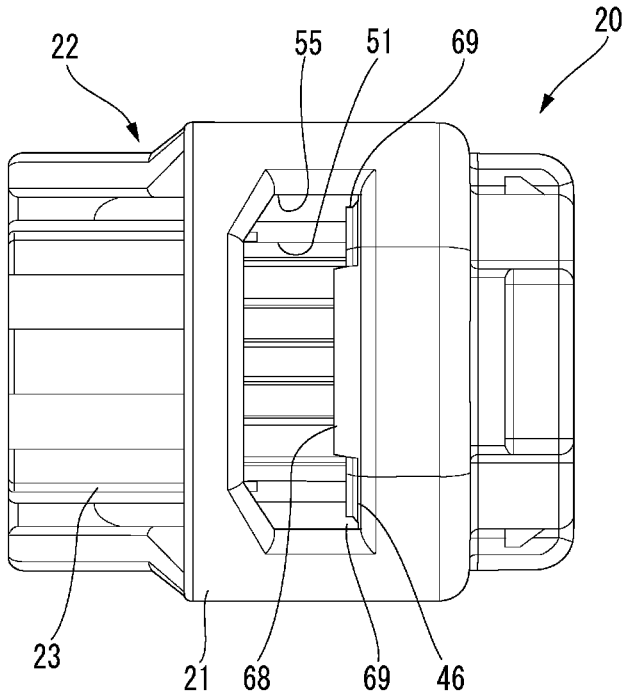
Figure 6B:
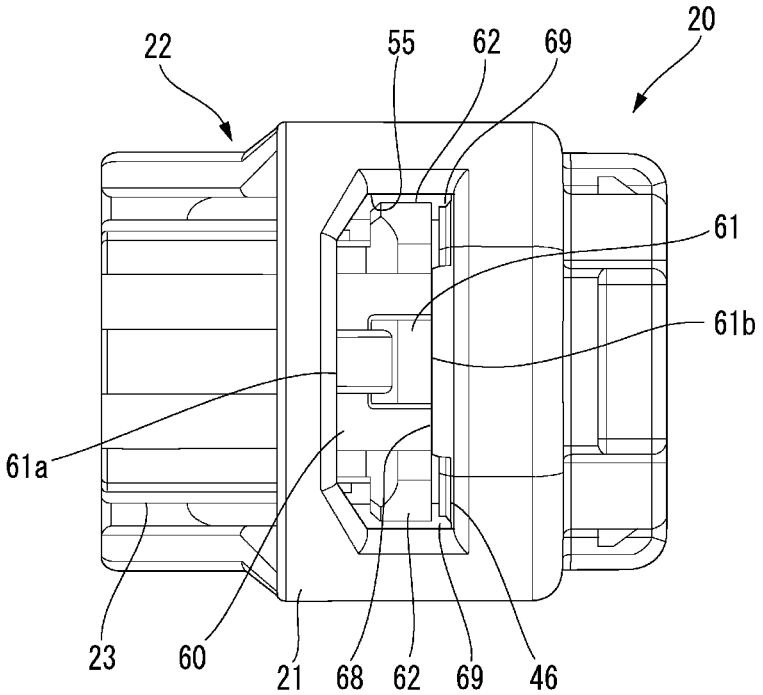
Figure 7A:
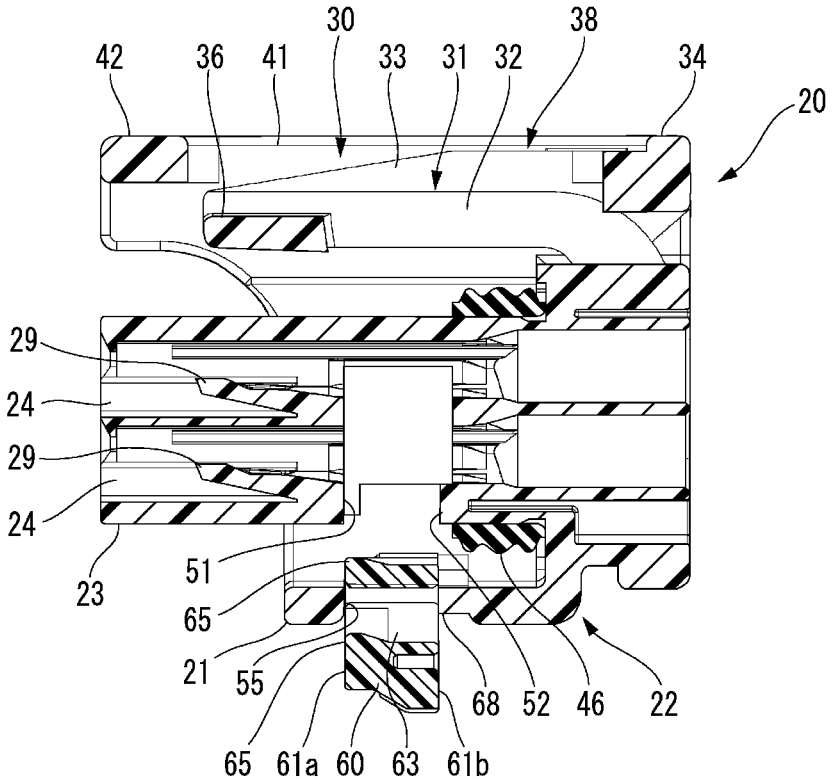
Figure 7B:
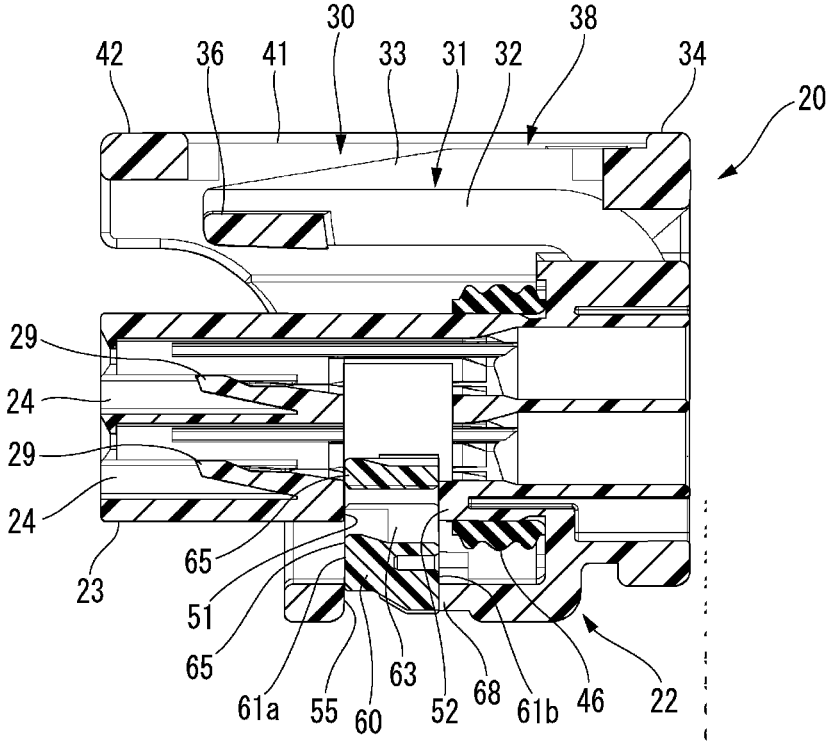

FIGS. 6A and 6B are views illustrating the retainer accommodating hole and the opening portion, in which FIG. 6A is a back view of the female housing before the retainer is mounted, and FIG. 6B is a back view of the female housing after the retainer is mounted. FIGS. 7A and 7B are views illustrating the retainer accommodating hole and the opening portion, in which FIG. 7A is a cross-sectional view corresponding to FIG. 2 before the retainer is mounted, and FIG. 7B is a cross-sectional view corresponding to FIG. 2 after the retainer is mounted.

As shown in FIGS. 6A and 7A, the retainer accommodating hole 51 formed in the fitting portion 23 has an inner shape slightly larger than an outer shape of the retainer main body 61. Therefore, the retainer main body 61 of the retainer 60 is fitted into the retainer accommodating hole 51. On the other hand, the opening portion 55 formed in the hood portion 21 has an inner shape larger than an outer shape of the retainer 60 including the locking pieces 62 as viewed from below. Therefore, the entire retainer 60 including the locking pieces 62 can be inserted through the opening portion 55.

The opening portion 55 is formed to have a size slightly covering a mounting range of the seal member 46 attached on the base of the fitting portion 23. In the opening portion 55, a guide portion 68 is formed in a portion of an edge portion on the rear end side of the housing main body 22 excluding both end portions. The guide portion 68 is formed along the width direction of the housing main body 22. A position of an edge portion of the guide portion 68 is substantially the same as that of an edge portion of the positioning protruding portion 52 of the retainer accommodating hole 51 when viewed from the back side. Further, window portions 69 are formed at both sides of the guide portion 68 in the opening portion 55. The seal member 46 attached to the fitting portion 23 can be viewed through the window portions 69. That is, in the window portions 69 on both sides of the guide portion 68 in the opening portion 55, it is possible to visually check whether or not the seal member 46 is attached to the base of the fitting portion 23 and the state of the attached seal member 46.

As shown in FIGS. 6B and 7B, when the retainer 60 is inserted into the retainer accommodating hole 51 through the opening portion 55, the rear surface 61*b* of the retainer main body 61 is slidably in contact with the guide portion 68. Therefore, the retainer 60 is accurately guided to the retainer accommodating hole 51 without being shifted. Therefore, the retainer 60 is prevented from being inserted in a state of being shifted toward the seal member 46 attached to the fitting portion 23. Further, the retainer 60 guided by the guide portion 68 of the opening portion 55 and inserted into the retainer accommodating hole 51 is positioned by the positioning protruding portion 52 on the edge portion of the retainer accommodating hole 51.

Next, a case where the female terminals 26 connected to the end portions of the electric wires 25 are accommodated in the terminal accommodating chambers 24 of the fitting portion 23 of the female housing 20 having the retainer 60 will be described.

In order to accommodate the female terminal 26 in the terminal accommodating chamber 24, first, the retainer 60 is inserted into the retainer accommodating hole 51. Then, the temporary locking claws 66 of the locking pieces 62 of the retainer 60 are locked to the temporary locking protrusions 53 of the fitting portion 23 to be in a temporarily locked state (see FIGS. 2 and 4).

Next, in the temporarily locked state, the female terminal 26 is inserted into the terminal accommodating chamber 24 from the rear side, and the lance 29 is locked to the protruding piece 28*a* of the female terminal 26. Then, after the female terminal 26 is inserted into the terminal accommodating chamber 24, the retainer 60 is pushed in, and the final locking claws 67 of the locking pieces 62 are locked to the final locking protrusions 54 of the fitting portion 23 to be in a final locked state. Then, the terminal locking portion 65 of the retainer 60 enters the rear end of the electrical connection portion 28 of the female terminal 26 accommodated in the terminal accommodating chamber 24. Therefore, the female terminal 26 is double-locked by the lance 29 and the retainer 60. When the retainer 60 is pushed in, if the insertion of the female terminal 26 into the terminal accommodating chamber 24 is incomplete, the retainer 60 interferes with the electrical connection portion 28 and cannot be pushed in. Accordingly, the operator can recognize that the insertion of the female terminal 26 into the terminal accommodating chamber 24 is insufficient.

Next, a case where the female housing 20 is fitted to the male housing 70 will be described.

The fitting portion 23 is fitted to the connection portion 71 of the male housing 70 by bringing the hood portion 21 of the female housing 20 close to the connection portion 71. Then, the lock mechanism 30 is guided by the guiding ridges 72 of the male housing 70, and the locking portion 36 of the lock arm 31 of the female housing 20 comes into contact with the guide surface 74 of the protruding portion 73 of the male housing 70.

When the female housing 20 is pushed into the male housing 70, the locking portion 36 of the lock arm 31 that is in contact with the guide surface 74 of the protruding portion 73 slides along the guide surface 74 and starts to ride, and the elastic arm portion 32 of the lock arm 31 is elastically deformed. As a result, the support arm portion 33 of the release arm 38 swings when a front end side connected to the elastic arm portion 32 is displaced away from the housing main body 22.

When the locking portion 36 climbs over the protruding portion 73 by further pushing the female housing 20 into the male housing 70, the elastic arm portion 32 that is elastically deformed is restored, the support arm portion 33 swings in a reverse direction, and the locking portion 36 enters the leading side in the fitting direction of the protruding portion 73 and is locked. Thus, the female housing 20 is locked with the male housing 70 while being fitted. In this fitted state, the connection portion 71 of the male housing 70 is in close contact with the seal member 46 attached to the fitting portion 23 of the female housing 20, and the fitting position of the male housing 70 and the female housing 20 is sealed. Then, in this fitted state, the male terminal is inserted into the electrical connection portion 28 of the female terminal 26, so that the female terminal 26 and the male terminal are electrically connected.

Next, a case where the female housing 20 is detached from the male housing 70 will be described.

In order to detach the female housing 20 from the male housing 70, the operation portion 34 provided at the rear end of the support arm portion 33 of the release arm 38 is pressed toward the housing main body 22. Then, the support arm portion 33 is swung, the locking portion 36 of the lock arm 31 is displaced in a direction away from the housing main body 22, the locking of the locking portion 36 to the protruding portion 73 is released, and the lock of the female housing 20 to the male housing 70 is released.

In this state, the female housing 20 is moved in a direction in which the female housing 20 is separated from the male housing 70. Accordingly, the female housing 20 is detached from the male housing 70, and the electrical connection between the female terminal 26 and the male terminal is released.

As described above, according to the female housing 20 of the present embodiment, the opening portion 55 through which the retainer 60 inserted into the retainer accommodating hole 51 is formed at a position facing the female housing 51 in the hood portion 21, and the guide portion 68 that is slidably in contact with the retainer 60 to guide the retainer 60 into the retainer accommodating hole 51 is provided at the edge portion of the opening portion 55. Therefore, when the retainer 60 is inserted into the retainer accommodating hole 51 of the fitting portion 23 through the opening portion 55, the retainer 60 is guided to the retainer accommodating hole 51 by the guide portion 68 provided at the edge portion of the opening portion 55. Accordingly, damage to the seal member 46 due to the shift of the retainer 60 through the opening portion 55 and interference with the seal member 46 can be prevented, and good sealing performance by the seal member 46 can be secured.

Further, the opening portion 55 through which the retainer 60 passes has the window portion 69 through which the seal member 46 attached to the fitting portion 23 can be visually checked. Therefore, in the window portions 69, it is possible to visually check whether or not the seal member 46 is attached to the base of the fitting portion 23 and the state of the attached seal member 46.

In addition, the positioning protruding portion 52 for positioning the retainer 60 is provided at the edge portion of the retainer accommodating hole 51. Therefore, the retainer 60 guided by the guide portion 68 of the opening portion 55 and inserted into the retainer accommodating hole 51 can be accurately positioned by the positioning protruding portion 52 on the edge portion of the retainer accommodating hole 51. Accordingly, the accuracy of the locking position of the female terminal 26 by the retainer 60 can be improved, and the rattling of the female terminal 26 accommodated in the terminal accommodating chamber 24 can be prevented.

The present invention is not limited to the embodiment described above, and modifications, improvements, or the like can be made as appropriate. In addition, materials, shapes, dimensions, numbers, arrangement locations and the like of elements in the above embodiment are optional and not limited as long as the object of the present invention can be achieved.

Here, characteristics of the housing according to the embodiment of the present invention described above will be briefly summarized in the following [1] to [3], respectively.

[1] A housing (female housing 20) including:

a housing main body (22) having:

a fitting portion (23) configured to be fitted with a mating housing (male housing 70) and having a terminal accommodating chamber (24) in which a terminal (female terminal 26) is accommodated, and a hood portion (21) which covers a periphery of the fitting portion (23);

an annular seal member (46) configured to be attached to a base part of the fitting portion (23) and to seal a fitting position of the fitting portion (23) and the mating housing (male housing 70); and a retainer (60) configured to be inserted into a retainer accommodating hole (51) and to lock the terminal (female terminal 26) accommodated in the terminal accommodating chamber (24), the retainer accommodating hole (51) being formed in the fitting portion (23) and being opened at a side part of the fitting portion (23), in which an opening portion (55) through which the retainer (60) passes to be inserted into the retainer accommodating hole (51) is formed at a position facing the retainer accommodating hole (51) in the hood portion (21); and a guide portion (68) that is slidably in contact with the retainer (60) to guide the retainer (60) into the retainer accommodating hole (51) when the retainer (60) is inserted into the retainer accommodating hole (51) is provided at an edge portion of the opening portion (55).

[2] In the housing according to [1], the opening portion (55) has a window portion (69) through which the seal member (46) attached to the fitting portion (23) is able to be visually checked by an operator.

[3] The housing according to [1] or [2], wherein the window portion (69) is provided at each of both sides of the guide portion (68) on the opening portion (55).

[4] In the housing according to any one of [1] to [3], a positioning protruding portion (52) that positions the retainer (60) is provided at an edge portion of the retainer accommodating hole (51).

What is claimed is:

1. A housing comprising:

a housing main body comprising:

a fitting portion configured to be fitted with a mating housing and having a terminal accommodating chamber in which a terminal is accommodated; and a hood portion which covers a periphery of the fitting portion;

an annular seal member configured to be attached to a base part of the fitting portion and to seal the fitting portion and the mating housing in a fitting position; and a retainer configured to be inserted into a retainer accommodating hole and to lock the terminal accommodated in the terminal accommodating chamber, the retainer accommodating hole being formed in the fitting portion and being opened at a side part of the fitting portion, wherein an opening portion through which the retainer passes to be inserted into the retainer accommodating hole is formed at a position facing the retainer accommodating hole in the hood portion, the opening portion has an inner shape larger than an outer shape of the retainer;

wherein a guide portion protrudes into the opening portion from an edge portion of the opening portion and is slidably in contact with the retainer to guide the retainer into the retainer accommodating hole when the retainer is inserted into the retainer accommodating hole, and wherein the guide portion has a first side surface and a second side surface, and the seal member extends past the first side surface and the second side surface of the guide portion in a width direction of the housing main body, the width direction being substantially perpendicular to both of a fitting direction in which the fitting portion is fitted with the mating housing and an inserting direction in which the retainer is inserted into the retainer accommodating hole.

2. The housing according to claim 1, wherein the opening portion has a window portion bounded by the retainer, the guide portion, and the edge of the opening portion through which the seal member attached to the fitting portion is able to be visually checked by an operator when the retainer is inserted in the retainer accommodating hole.

3. The housing according to claim 2, wherein the window portion is provided at each of both sides of the guide portion on the opening portion in the width direction of the housing main body.

4. The housing according to claim 1, wherein a positioning protruding portion protrudes into the retainer accommodating hole from an edge portion of the retainer accommodating hole that is adjacent to the seal member and is aligned with the guide portion to position the retainer in the retainer accommodating hole.

* * * * *